United States Patent [19]

Yon et al.

[11] Patent Number: 4,813,740

[45] Date of Patent: Mar. 21, 1989

[54] CLOSURE FOR SEAT BACK COVER

[75] Inventors: Ronald R. Yon, Westland; Donald H. Munroe, Livonia, both of Mich.

[73] Assignee: Ford Motor Company, Dearborn, Mich.

[21] Appl. No.: 135,106

[22] Filed: Dec. 18, 1987

[51] Int. Cl.[4] ..... A47C 31/10

[52] U.S. Cl. ..... 297/219; 297/224

[58] Field of Search ..... 297/219, 229, 224; 24/20 TT

[56] References Cited

U.S. PATENT DOCUMENTS

| | | | |
|---|---|---|---|
| 712,765 | 11/1902 | Cole | 24/20 TT |
| 2,229,160 | 1/1941 | Wittcoff | 297/219 |
| 3,995,892 | 12/1976 | Hellman et al. | 297/219 |
| 4,183,120 | 1/1980 | Thorne | 24/20 TT |
| 4,453,289 | 6/1984 | Kleykamp et al. | 24/20 TT |
| 4,693,511 | 9/1987 | Seltzer et al. | 297/219 |

*Primary Examiner*—Francis K. Zugel

*Attorney, Agent, or Firm*—Daniel M. Stock; Clifford L. Sadler

[57] ABSTRACT

An automotive seat back cover includes an improved closure member that permits fastening the cover to the seat back upon the imposition of a force urging two plastic snap members together.

9 Claims, 1 Drawing Sheet

CLOSURE FOR SEAT BACK COVER

BACKGROUND OF THE INVENTION

The present invention relates generally to automotive seating, and more particularly to means for securing the covers to the seat backs of such seating.

Description of the Prior Art

In the assembly of automobiles, the assembly of upholstery-like trim items to the interior of the automobiles is a labor intensive process. One of the most difficult jobs to accomplish has been the fitting of a seat back cover to front seats. These covers are typically fabricated as envelope-like elements which are manually slid over a cushioned seat frame to a position where the loose open ends of the envelope are secured through agency of manually securing clips, stitching or other fastening devices. Exemplary of such covers are those disclosed in U.S. Pat. No. 4,669,779 to Kaganas et al.

SUMMARY OF THE INVENTION

Responsive to the needs to improve productivity and efficiency in the assembly of automotive vehicles, it is desired to make assembly operations such as the fitting of seat back covers capable of being effected through automatic or robot aided assembly processes. In the alternative, improvement in the manual, hand tool aided assembly process is desired.

To take advantage of automation techniques, however, it is necessary to improve the design of the seat back cover itself to facilitate such operations. It is accordingly an object of the present invention to provide an automobile seat back cover that provides locking means readily and simply engageable with tooling or manual or automatic closure equipment for assembly of the seat back cover over a cushioned back assembly.

It is a further object of the present invention to make such closure mechanism as an integral part of the seat back cover.

According to a feature of the present invention, a two-piece snap-closure mechanism is carried along the periphery of the open edge of the seat back cover which is engaeable by the simple imposition of a force urging the two pieces together.

BRIEF DESCRIPTION OF THE DRAWINGS

These and other objects and features will be apparent to those skilled in the automotive seating arts by reading the following description with reference to the accompanying drawings in which.

DESCRIPTION OF THE PREFERRED EMBODIMENT

Figure 1:
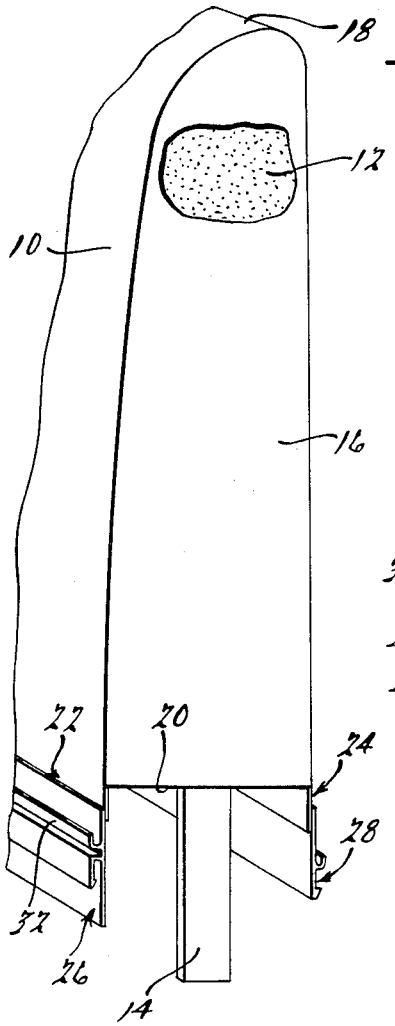
FIG. 1 is a perspective view of an automobile seat back, partially in section, on which a seat cover member is partially installed.

Turning now to the drawings and particularly to FIG. 1 thereof, an automobile seat back 10 is illustrated as comprising generally a cushion 12 which is mounted in a known manner on a channel support member 14 for eventual assembly to the base of the seat (not shown). A seat cover member 16 is formed in envelope fashion to be slipped over the channel mounted cushion 12. The seat cover 16 may be formed of many flexible materials comfortable to the touch, such as fabrics, leathers and plastics. The cover 16 is here illustrated as being closed at its top edge 18 and open at its bottom 20. The bottom 20 generally forms a somewhat rectangular opening, having front and rear edges 22 and 24 respectively. To secure the seat cover 16 to the channel mounted cushion 12, it is necessary to effect a closure at the bottom of edge 20. In the preferred embodiment illustrated, the seat back 10 is shown as including first and second snap members 26 and 28, which are configured to permit snap closure of the seat cover 16 over the cushion 12.

Figure 2:
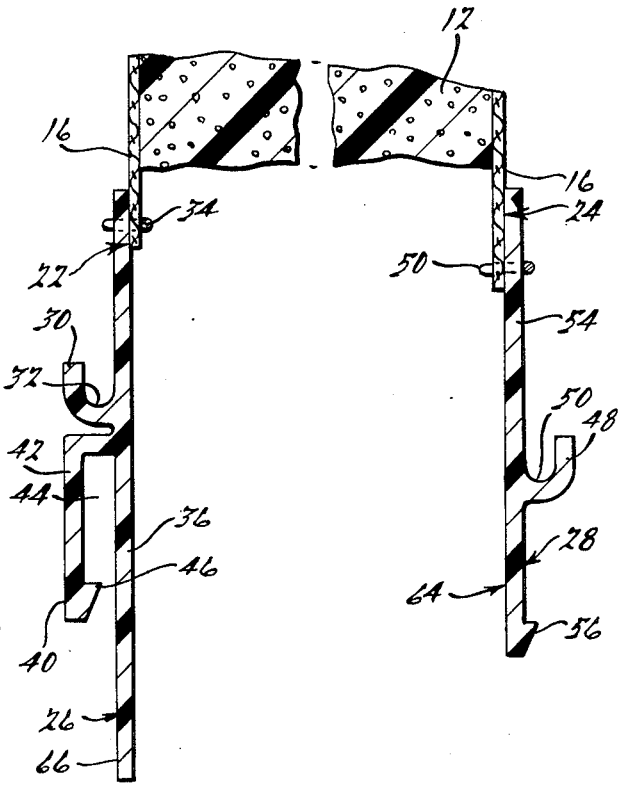
FIG. 2 is an enlarged cross-sectional view of the bottom portion of the seat back of FIG. 1.
Figure 3:
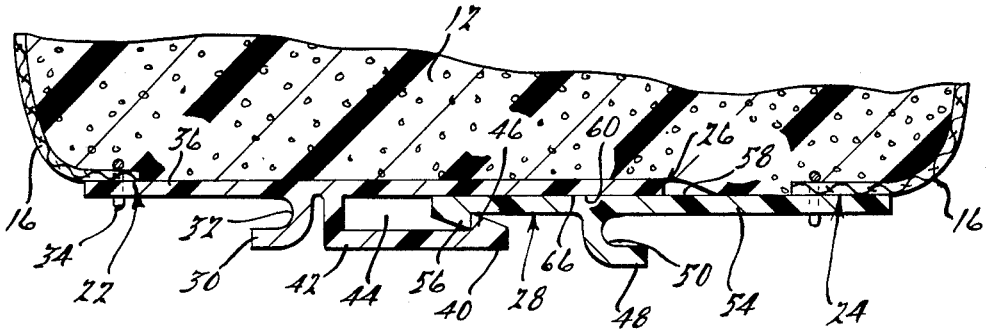
FIG. 3 is an enlarged cross-sectional view similar to FIG. 2 showing the closure member in its locked position.

Turning next to FIGS. 2–3, the snap members 26, 28 are shown in more detail. First snap member 26 is illustrated as including a drive portion 30 which extends laterally across the width of the seat assembly 10, as may best be seen in FIG. 1. The drive portion 30 is generally "J" shaped in cross-section to provide a tool receiving recess 32 as may best be seen in FIG. 2. The drive portion 30 is illustrated as being fixed to the lower edge of the front face 22 of the seat cover 16 as by stitching as indicated at 34. Extending downwardly from drive portion 30, as viewed in FIG. 2, is base portion 36. Formed integrally with the base portion 36 and the drive portion 30 is a catch portion 40 which includes a flexible catch leg member 42 spaced outwardly from the base portion 36 in cantilever fashion to define a channel 44 proximate the open end of which is a hook 46.

The second snap member 28 is illustrated as including a drive portion 48 similar in configuration to the drive portion 30 and including a tool receiving surface 50 in its "J" cross-sectional configuration. It, too, extends substantially across the width of the seat back assembly 10. The snap member 28 is secured by stitching or like agency at 52 to the rear surface 24 of the seat cover 16. Another base portion 54 with which the drive portion 48 is integrally formed extends downwardly to terminate at its free end in a hook 56 similar in configuration to the hook 46 of first snap member 26.

Turning last to FIG. 3, the closed position of the seat cover 16 as effected by snap members 26, 28 is illustrated. Drive portions 30, 48 are engaged by suitable closure tools urging the flexible seat cover 16 to wrap around toward the vertical medial plane of the seat so that the inner face 60 of the base portion 54 slidingly engages the outer face 66 of the base portion 36 of the snap member 26 to permit insertion of the hook 56 into the channel 44 through outward flexing of the leg 42. It will be readily appreciated by those skilled in the automotive assembly arts that manual engagement of the snap members 26, 28 may also be accomplished by urging them together along the simply defined closure path. Release of the tool load, which may effect some compression of the cushion 12, permits the locking abutting relationship of the hooks 46, 56 as illustrated in FIG. 3. For at least some configurations of the cushion 12, it has been found advantageous to form all parts of the snap members 26, 28 of matching upward (as viewed in FIG. 3) concavity to facilitate rolling cam-like operation of automatic or manual tools for effecting closure.

While only one embodiment of the invention closure assembly has been disclosed, others may be possible without departing from the scope of the appended claims.

We claim:

1. A closure mechanism for an automotive seat back cover, the seat cover being of the type formed for sliding engagement over a seat back having support channels and a cushion and having at least one open end, the closure mechanism comprising:

a first snap member fixedly secured to the seat cover proximate the open end thereof;

a second snap member fixedly secured to the seat cover proximate the open end thereof in juxtaposition with the first snap member; and means disposed on the first and second snap members to permit snap-fit engagement of the snap members solely upon the imposition of a force urging the snap members together, the permitting means comprising:

an elongated base portion forming a part of each snap member and extending substantially across the width of the seat back including means for effecting attachment to the seat cover;

a drive portion adapted to be engaged by a closure tool and integrally formed with the base portion of each snap member;

a hook portion integrally formed with the base portion of one of the snap members; and a catch portion integrally formed with the other of the snap members and defining a channel for receiving the hook portion in snap-fit relationship.

2. A closure mechanism as defined in claim 1 wherein at least the hook portion and the catch portion are formed to be laterally coextensive with the base portions.

3. A closure mechanism as defined in claim 1 wherein the catch portion includes a flexible catch leg member extending parallel to and offset from the base portion in cantilever fashion to define a channel therewith, the catch leg having a hook formed proximate its free end for abuttingly engaging the other snap member hook portion.

4. A closure mechanism as defined in claim 2 wherein the catch portion includes a flexible catch leg member extending parallel to and offset from the base portion in cantilever fashion to define a channel therewith, the catch leg having a hook formed proximate its free end for abuttingly engaging the other snap member hook portion.

5. A closure mechanism as defined in claim 1 wherein the snap members are integrally formed as plastic members.

6. A closure mechanism as defined in claim 1 wherein the drive portions each comprise a tool receiving surface facing outwardly away from the other snap member.

7. A closure mechanism as defined in claim 1 wherein the drive portions each comprise a tool receiving surface facing outwardly away from the other snap member.

8. A cover for an automotive seat back having a cushion, the cover being formed in envelope fashion having a closed end engaging the top surface of the seat back and an open bottom end closable by an improved closure mechanism comprising:

a first snap member fixedly secured to the seat cover proximate the open end thereof;

a second snap member fixedly secured to the seat cover proximate the open end thereof in juxtaposition with the first snap member; and means disposed on the first and second snap members to permit snap-fit engagement of the snap members solely upon the imposition of a force urging the snap members together and compressing the seat back cushion, the permitting means comprising:

an elongated base portion forming a part of each snap member and extending substantially across the width of the seat back including means for effecting attachment to the seat cover;

a drive portion adapted to be engaged by a closure tool and integrally formed with the base portion of each snap member;

a hook portion integrally formed with the base portion of one of the snap members; and a catch portion integrally formed with the other of the snap members and defining a channel for receiving the hook portion in snap-fit relationship.

9. A closure mechanism as defined in claim 8 wherein the catch portion includes a flexible catch leg member extending parallel to and offset from the base portion in cantilever fashion to define a channel therewith, the catch leg having a hook formed proximate its free end for abuttingly engaging the other snap member hook portion upon removal of the force compressing the seat back cushion.

* * * * *